US010500865B2

(12) United States Patent
Kobayashi

(10) Patent No.: US 10,500,865 B2
(45) Date of Patent: Dec. 10, 2019

(54) LIQUID EJECTING UNIT AND LIQUID EJECTING APPARATUS

(71) Applicant: Seiko Epson Corporation, Tokyo (JP)

(72) Inventor: Haruki Kobayashi, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/207,863

(22) Filed: Dec. 3, 2018

(65) Prior Publication Data

US 2019/0111690 A1 Apr. 18, 2019

Related U.S. Application Data

(62) Division of application No. 15/370,598, filed on Dec. 6, 2016, now abandoned.

(30) Foreign Application Priority Data

Dec. 8, 2015 (JP) ..... 2015-239129
Sep. 28, 2016 (JP) ..... 2016-189246

(51) Int. Cl.
*B41J 2/175* (2006.01)
*B41J 2/14* (2006.01)

(52) U.S. Cl.
CPC ..... *B41J 2/175* (2013.01); *B41J 2/14233* (2013.01); *B41J 2002/14419* (2013.01)

(58) Field of Classification Search
CPC ..... B41J 2/175; B41J 2/14233; B41J 2002/14419
See application file for complete search history.

(56) References Cited

U.S. PATENT DOCUMENTS 5,359,357 A 10/1994 Takagi et al.
6,286,932 B1 9/2001 Hirano
2013/0033539 A1* 2/2013 Watanabe ..... B41J 2/14274 347/20

FOREIGN PATENT DOCUMENTS

JP 2000-218814 A 8/2000
JP 2001-179957 A 7/2001
JP 2002-103573 A 4/2002
JP 2002-113846 A 4/2002
JP 2015-123677 A 7/2015

* cited by examiner

*Primary Examiner* — Yaovi M Ameh
(74) *Attorney, Agent, or Firm* — Harness, Dickey & Pierce, P.L.C.

(57) ABSTRACT

A liquid ejecting unit includes a flow channel portion that includes a flow channel through which a liquid passes, a liquid ejecting head that is stacked on the flow channel portion in a first direction and ejects the liquid, which passes through the flow channel, from a nozzle, and a support body that supports the flow channel portion, and a concave portion that is recessed in the first direction and accommodates at least a portion of the flow channel portion is formed in the support body.

7 Claims, 6 Drawing Sheets

LIQUID EJECTING UNIT AND LIQUID EJECTING APPARATUS

CROSS-REFERENCE TO RELATED APPLICATIONS

This application is a divisional application of U.S. patent application Ser. No. 15/370,598, filed Dec. 6, 2016, which claims priority to Japanese Patent Application Nos. 2015-239129, filed Dec. 8, 2015, and 2016-189246, filed Sep. 28, 2016, all of which are expressly incorporated by reference herein in their entireties.

BACKGROUND

1. Technical Field

The present invention relates to a technique that ejects a liquid such as ink.

2. Related Art

A liquid ejecting head that ejects a liquid such as ink, which is supplied from a liquid container, from a nozzle has been proposed in the related art. For example, JP-A-2015-123677 discloses a serial type liquid ejecting apparatus in which a liquid container is mounted in a box form carriage in which a liquid ejecting head is installed, and the corresponding carriage is caused to reciprocate with respect to a medium such as printing paper.

However, in the configuration disclosed in JP-A-2015-123677, since a flow channel for supplying a liquid to the liquid ejecting head from the liquid container is installed above a bottom surface portion of the carriage, it is difficult to reduce the height of the entire apparatus (hereinafter, referred to as "profile reduction").

SUMMARY

An advantage of some aspects of the invention is to effectively reduce the profile of a liquid ejecting unit.

According to an aspect of the invention, there is provided a liquid ejecting unit including a flow channel portion that includes a flow channel through which a liquid passes, a liquid ejecting head that is disposed stacked on the flow channel portion in a first direction and ejects the liquid, which passes through the flow channel, from a nozzle, and a support body that supports at least the flow channel portion, in which a concave portion that is recessed in the first direction is provided in the support body, and at least a portion of the flow channel portion is accommodated inside the concave portion of the support body. In the above-mentioned configuration, since the concave portion, which accommodates at least a portion of the flow channel portion and is recessed in the first direction, is formed in the support body, at least a portion of the flow channel portion and the support body overlap in the first direction as a result of at least a portion of the flow channel portion being positioned on an inner side of the concave portion, it is possible to reduce the profile (that is, reduce the height (the dimension in the first direction) of the liquid ejecting unit) of the liquid ejecting unit in the first direction in comparison with a configuration in which a flow channel portion is installed above a flat plate form support body that supports the flow channel portion (a configuration in which the flow channel portion and the support body do not overlap in the first direction), for example.

In a preferred aspect of the invention, the support body may include a bottom surface portion to which the flow channel portion is fixed, and the concave portion may be formed in the bottom surface portion. In the above-mentioned configuration, since the concave portion is formed in the bottom surface portion to which the flow channel portion is fixed, in comparison with a configuration in which a concave portion is not formed in a bottom surface portion (a configuration in which the flow channel portion is installed above a flat plate form bottom surface portion), for example, it is possible to reduce the profile of the liquid ejecting unit by positioning at least a portion of the flow channel portion on an inner side of the concave portion.

In a preferred aspect of the invention, the support body may be provided with an opening inside the concave portion, and an exposed portion, which is at least a portion of the flow channel portion, may be exposed from the opening. That is, among portions of the support body, since the opening is formed in a portion that corresponds to the exposed portion, it is possible to reduce the thickness in the first direction of the liquid ejecting unit.

In a preferred aspect of the invention, the flow channel portion may be supported by the support body using a plurality of connection portions, and the exposed portion may be positioned inside a region that is demarcated by the plurality of connection portions. In the above-mentioned configuration, since the exposed portion is installed on an inner side of a region that is demarcated by the plurality of connection portions, which connect the flow channel portion to the support body, among positions of the support body, at a position that corresponds to the connection portions that fix the flow channel portion, it is possible to ensure a thickness at which it is possible to ensure rigidity, and it is possible to minimize the distance from another constituent element (for example, a transport mechanism) that faces the exposed portion. In addition, even in a case in which deformation (warping and distortion), which is caused by connection of a mounting portion and the support body due to the connection portions, occurs in the mounting portion or the support body, the likelihood of interference or contact between the flow channel portion and another element (for example, a transport mechanism) is reduced.

According to another aspect of the invention, there is provided a liquid ejecting apparatus including the liquid ejecting unit according to each of the above-mentioned aspects. Since profile reduction is realized according to the liquid ejecting unit of each of the above-mentioned aspects, profile reduction of a liquid ejecting apparatus is realized according to configurations that are provided with the corresponding liquid ejecting units.

A preferred example of a liquid ejecting apparatus according to the invention may further include another constituent element that is disposed so as to face the exposed portion in the first direction. In a configuration in which a liquid ejecting unit faces another constituent element that configures a liquid ejecting apparatus, since it is assumed that it is likely that a support body of the liquid ejecting unit and the other constituent element will come into contact with one another, it is necessary to maintain a distance at which the support body and the other constituent element do not interfere with one another. However, by disposing another constituent element so as to face the exposed portion, since it is possible to bring the exposed portion of the flow channel portion, which is accommodated inside the support body, and the other constituent element closer up to a distance at which the two components do not interfere with one another, miniaturization of the liquid ejecting apparatus is possible.

In a preferred example of a liquid ejecting apparatus according to the invention, the flow channel portion may be provided with a mounting portion in which a liquid container that accommodates a liquid that passes through the flow channel, is installed, and, in a case of viewing from the first direction, the exposed portion of the flow channel portion may be in a position that overlaps with at least a portion of the liquid container, and may be in a position that does not overlap with the liquid ejecting head. In a case of viewing from the first direction, in a configuration in which the entire area of the flow channel portion is wider than the range of the liquid ejecting head without overlapping with the liquid ejecting head, it is easy to dispose another constituent element and a liquid ejecting unit facing one another by a corresponding amount. However, as a result of disposing the exposed portion in a position that overlaps with at least a portion of a liquid container and in a position that does not overlap with the liquid ejecting head, it is possible to prevent interference with the other constituent element without exerting an influence on the liquid ejecting properties of the liquid ejecting head.

In a preferred example of a liquid ejecting apparatus according to the invention, the other constituent element is a transport mechanism that transports a medium onto which a liquid that is ejected from the liquid ejecting head, is landed, and a plurality of liquid containers, which are arranged in a transport direction of the medium by the transport mechanism, are mounted in the mounting portion. In a configuration in which a plurality of liquid containers are mounted arranged in a transport direction of the medium by the transport mechanism, since the flow channel portion is formed throughout the entirety of the plurality of liquid containers, in a case of viewing from the first direction, a configuration in which the flow channel portion overhangs from the liquid ejecting head in a takeout direction, is necessary. Based on the above-mentioned configuration, even if a configuration in which the flow channel portion overhangs from the liquid ejecting head in the takeout direction, is used, according to a configuration in which the exposed portion of the flow channel portion is positioned inside a region that is demarcated by the plurality of connection portions, it is possible to reduce the likelihood of interference or contact between the exposed portion of the flow channel portion and another element (for example, a transport mechanism).

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
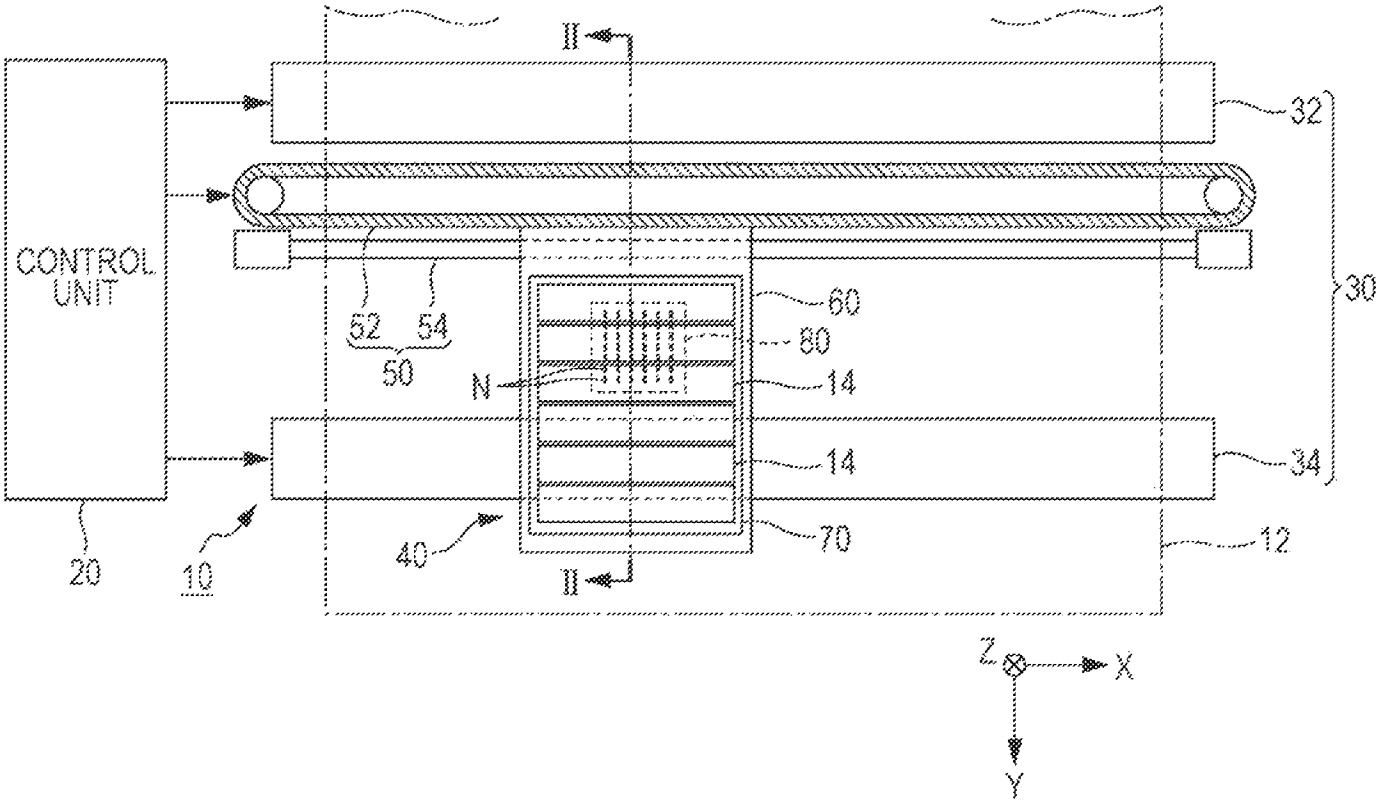
FIG. 1 is a configuration view of a liquid ejecting apparatus according to a preferred embodiment of the invention.

FIG. 1 is a configuration view of a liquid ejecting apparatus 10 according to a preferred embodiment of the invention. The liquid ejecting apparatus 10 of the embodiment is an ink jet type printing apparatus that ejects ink, which is an illustrative example of a liquid, onto a medium 12. A typical example of the medium 12 is printing paper, but it is possible to use various media 12 such as fabric or resin film.

As illustrated by way of example in FIG. 1, the liquid ejecting apparatus 10 is provided with a control unit 20, a transport mechanism 30, a liquid ejecting unit 40, and a movement mechanism 50. The control unit 20 is, for example, configured to include a control device such as a central processing unit (CPU) and a storage circuit such as semiconductor memory (not illustrated in the drawings), and controls each component of the liquid ejecting apparatus 10 in an integral manner as a result of the control device executing a program that is stored in the storage circuit.

The transport mechanism 30 transports the medium 12 in a Y direction on the basis of the control by the control unit 20. The transport mechanism 30 of the embodiment includes a supply side transport mechanism 32 and a discharge side transport mechanism 34. The transport mechanism 32 is installed on an upstream side (the negative side in the Y direction) of the transport mechanism 34 and supplies the medium 12 to the transport mechanism 34 side, and the transport mechanism 34 discharges the medium 12 that is supplied from the transport mechanism 32, to a downstream side (the positive side in the Y direction).

The liquid ejecting unit 40 is a component that ejects ink onto the medium 12, and is provided with a support body 60, a container holding body 70, and a liquid ejecting head 80. The support body 60 is a substantially box form housing (carriage) that supports the container holding body 70 and the liquid ejecting head 80. The container holding body supports a plurality of liquid containers 14, which accommodate different types of ink. For example, each liquid container 14 is an ink cartridge. As illustrated by way of example in FIG. 1, the container holding body 70 of the embodiment maintains the plurality of liquid containers 14 in a state of being arranged in the Y direction (that is, a transport direction of the medium 12). Each liquid container 14 is attached and removed to and from the container holding body 70 individually. The liquid ejecting head 80 is a recording head that ejects ink that is supplied from the plurality of liquid containers 14, onto the medium 12 from a plurality of nozzles on the basis of the control by the control unit 20.

The movement mechanism 50 is a mechanism that causes the liquid ejecting unit 40 to reciprocate in an X direction on the basis of the control by the control unit 20. The X direction in which the liquid ejecting unit 40 moves is a direction that intersects (typically is orthogonal to) the Y direction in which the medium 12 is transported. The movement mechanism 50 of the embodiment includes a transport belt 52, a guide shaft 54, and a driving motor (not illustrated in the drawings). The transport belt 52 is an endless belt that is provided in a hanging manner that is longitudinal in the X direction, and rotates as a result of the motive power of the driving motor. The support body 60 of the liquid ejecting unit 40 is fixed to the transport belt 52. The guide shaft 54 is a shaft body that is parallel to an X axis and is inserted through the support body 60, and regulates a movement direction of the support body 60 in the X direction.

Based on the above-mentioned configuration, the liquid ejecting unit 40 reciprocates on the positive side and the negative side in the X direction in an interlocked manner with rotation of the transport belt 52.

A desired image is formed on the outer surface of the medium 12 as a result of the liquid ejecting head 80 ejecting and landing ink on the medium 12 in parallel with transport of the medium 12 by the transport mechanism 30 and movement of the liquid ejecting unit 40 by the movement mechanism 50. Additionally, in the following description, as illustrated in FIG. 1, a direction that is perpendicular to an X-Y plane is noted as a Z direction (typically a vertical direction). The ink that is ejected from the liquid ejecting head 80 reaches the outer surface of the medium 12 by traveling on the positive side in the Z direction.

Additionally, the Z direction is an example of the "first direction".

Figure 2:
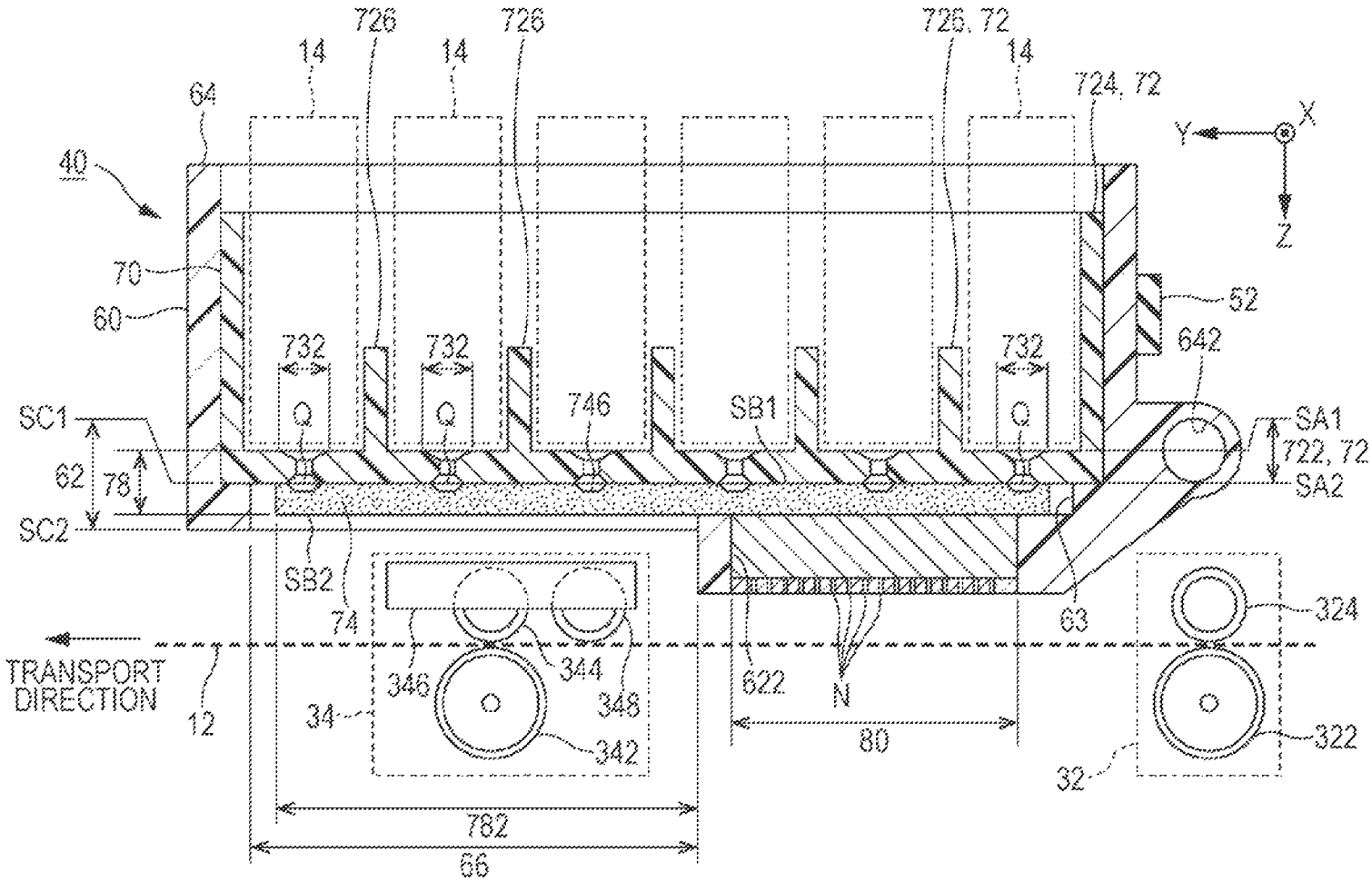
FIG. 2 is a cross-sectional view (a cross-sectional view of a line II-II in FIG. 1) of a liquid ejecting unit.

FIG. 2 is a cross-sectional view of a line II-II in FIG. 1 (a cross-section that is parallel to a Y-Z plane). As illustrated by way of example in FIG. 2, the supply side transport mechanism 32 includes a supply roller 322 and a supply roller 324 in which the central axes are parallel to the X direction. The medium 12 passes through the supply roller 322 and the supply roller 324 and is transported to the downstream side as a result of rotation of one or both of the supply roller 322 and the supply roller 324. The discharge side transport mechanism 34 includes a discharge roller 342 and a discharge roller 344 in which the central axes are parallel to the X direction, a structural body 346 (frame) that supports the discharge roller 342 and the discharge roller 344, and a regulation roller 348 that is supported by the structural body 346 and regulates lifting of the medium 12 (approaching the liquid ejecting head 80). As can be understood from FIG. 2, the medium 12 that is supplied from the transport mechanism 32 passes through a space below the liquid ejecting head 80, reaches the transport mechanism 34, and is discharged to the downstream side by passing through the discharge roller 342 and the discharge roller 344 as a result of rotation of one or both of the discharge roller 342 and the discharge roller 344. That is, the medium 12 is transported in the Y direction by the transport mechanism 30 (the transport mechanism 32 and the transport mechanism 34).

Figure 3:
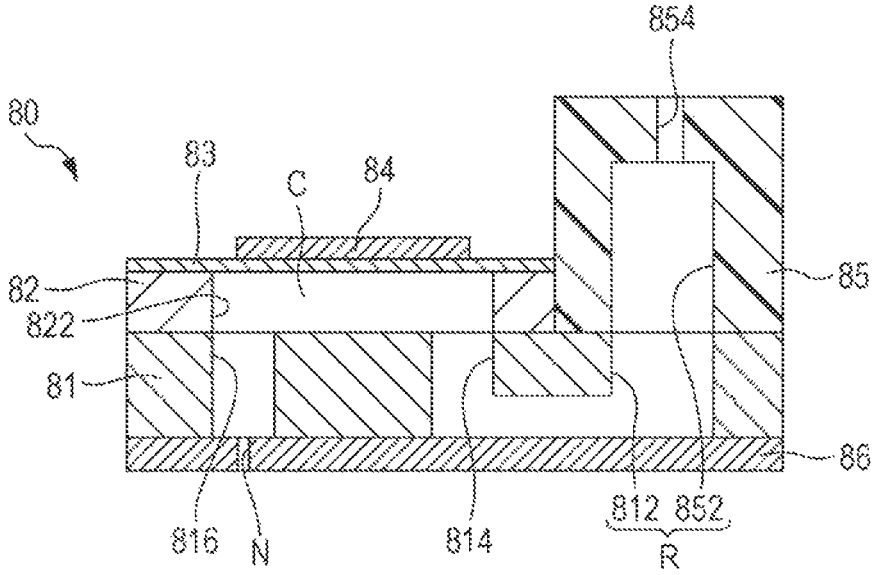
FIG. 3 is a cross-sectional view of components that are related to a single nozzle among nozzles of the liquid ejecting head.

As illustrated by way of example in FIG. 2, the liquid ejecting head 80 is provided with a plurality of nozzles (ejection ports) N that eject the ink that is supplied from each liquid container 14. FIG. 3 is a cross-sectional view focusing on a single arbitrary nozzle N of the liquid ejecting head 80. As illustrated by way of example in FIG. 3, the liquid ejecting head 80 is a structural body in which a pressure chamber substrate 82, a vibration plate 83, a piezoelectric device 84, and a housing portion 85 are disposed on one side of a flow channel substrate 81, and a nozzle plate 86 is disposed on the other side. The flow channel substrate 81, the pressure chamber substrate 82, and the nozzle plate 86 are formed by a silicon flat plate material, for example, and the housing portion 85 is formed by injection molding of a resin material, for example.

The plurality of nozzles N are formed in the nozzle plate 86. The respective plurality of nozzles N are through holes having circular cross-sections and having the Z direction as the axial direction (the direction of the central axis) thereof. As illustrated by way of example in FIG. 1, nozzle rows in which a plurality of nozzles N that eject a single type of ink supplied from a single arbitrary liquid container 14, are arranged in the Y direction, are arranged in the X direction mutually spaced apart in the plurality of liquid containers 14.

An opening portion 812, a branched flow channel (a narrowing flow channel) 814, and a communication flow channel 816 are formed in the flow channel substrate 81. The branched flow channel 814 and the communication flow channel 816 are through holes that are formed for each nozzle N, and the opening portion 812 is an opening that is continuous throughout the entirety of the plurality of nozzles N. A space that is mutually in communication with an accommodation portion (concave portion) 852 that is formed in the housing portion 85, and the opening portion 812 of the flow channel substrate 81, functions as a common liquid chamber R (a reservoir) in which the ink that is supplied from the liquid container 14 via an introduction port 854 of the housing portion 85, is retained.

An opening portion 822 is formed in the pressure chamber substrate 82 for each nozzle N. The vibration plate is a flat plate material that is installed on the outer surface of a side of the pressure chamber substrate 82 that is opposite to the flow channel substrate 81 and is capable of elastic deformation. A space that is interposed between the vibration plate 83 and the flow channel substrate 81 on the inner side of each opening portion 822 of the pressure chamber substrate 82, functions as a pressure chamber (cavity) C that is filled with the ink that is supplied from the common liquid chamber R via the branched flow channel 814. Each pressure chamber C is in communication with a nozzle N via the communication flow channel 816 of the flow channel substrate 81.

The piezoelectric device 84 is formed for each nozzle N on the outer surface of the vibration plate 83 on a side that is opposite to the pressure chamber substrate 82. Each piezoelectric device 84 is a driving element in which a piezoelectric body is interposed between a pair of electrodes that face one another. When the vibration plate 83 vibrates as a result of the piezoelectric device 84 becoming deformed due to the supply of a driving signal, the pressure inside the pressure chamber C fluctuates, and the ink inside the pressure chamber C is ejected from the nozzle N. Additionally, in the embodiment, a piezoelectric type liquid ejecting head 80 that uses the piezoelectric device 84, which applies mechanical vibrations to the pressure chamber C is illustrated by way of example, but it is also possible to adopt a heat-emitting element that generates air bubbles in an inner portion of a pressure chamber due to heating, as a driving element.

Figure 4:
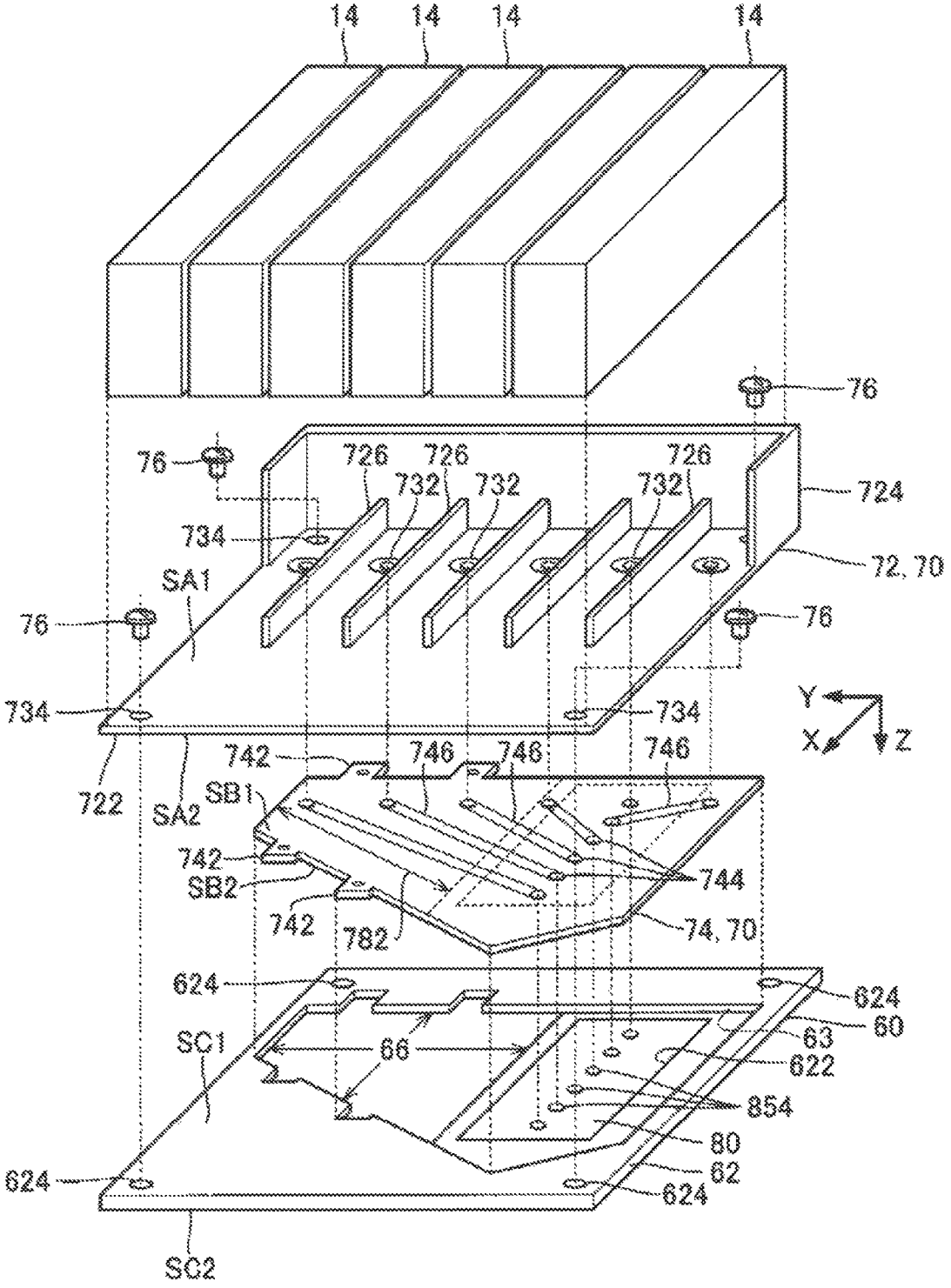
FIG. 4 is an exploded perspective view of the liquid ejecting unit.

FIG. 4 is an exploded perspective view of the liquid ejecting unit 40. As illustrated by way of example in FIGS. 2 and 4, the container holding body 70 of the embodiment includes a mounting portion 72 and a sealing portion 74. The mounting portion 72 and the sealing portion 74 are mutually formed in an individual manner using injection molding of a resin material, for example.

The mounting portion 72 is a structural body in which the plurality of liquid containers 14 are mounted, and includes a base portion 722, side wall portions 724, and a plurality of dividing wall portions 726. The base portion 722 is a substantially flat plate form section that includes an outer surface (hereinafter, referred to as a "mounting surface") SA1 onto which the plurality of liquid containers 14 are mounted, and an outer surface (hereinafter, referred to as a "fixing surface") SA2 that is on a side that is opposite to the mounting surface SA1. The side wall portions 724 are wall form sections that project along the peripheral edges of the base portion 722 from the mounting surface SA1. The plurality of dividing wall portions 726 are dividing walls that project from the mounting surface SA1 of the base portion 722 in a manner that partitions spaces in which each liquid container is mounted. As illustrated by way of example in FIGS. 2 and 4, a plurality of introduction ports 732, which correspond to the different liquid containers 14, are formed in the base portion 722. The plurality of liquid containers 14 are mounted and held on the mounting surface SA1 in a manner in which, among portions of the liquid containers 14, supply ports (not illustrated in the drawings) through which ink flows out, are in communication with the introduction ports 732. In addition, a plurality of through holes 734, through which screws 76 for fixing the mounting portion 72 to the support body 60 are inserted, are formed in each corner portion (the four corners) of the base portion 722 of the container holding body 70.

As illustrated by way of example in FIGS. 2 and 4, the sealing portion 74 is a substantially flat plate form member that includes an outer surface (hereinafter, referred to as a "flow channel surface") SB1 facing the base portion 722 of the mounting portion 72, and an outer surface (hereinafter, referred to as an "exterior outer surface") SB2 that is on a side that is opposite to the flow channel surface SB1. The sealing portion 74 is fixed to the base portion 722 in a state in which the flow channel surface SB1 is adhered to the fixing surface SA2 of the base portion 722. A plurality of attachment portions 742 are formed on the outer peripheral surface of the sealing portion 74. The sealing portion 74 is fixed to the mounting portion 72 (the base portion 722) using an arbitrary fixing method such as thermal caulking that causes thermal deformation in a state in which the projections of the fixing surface SA2 are inserted into the through holes that are formed in each attachment portion 742, or screwing using screws that are inserted into the through holes of the attachment portions 742.

As illustrated by way of example in FIG. 4, a plurality of communication ports 744 and a plurality of groove portions 746 are formed in the flow channel surface SB1 of the sealing portion 74. Each communication port 744 is a through hole that is in communication with a single introduction port 854 of the liquid ejecting head 80. Each of the plurality of groove portions 746 is an indentation that is formed in the flow channel surface SB1 in a linear form (a straight line form or a curved line form). In a state in which the sealing portion 74 is fixed to the mounting portion 72, as illustrated by way of example in FIG. 2, a plurality of flow channels Q, which are surrounded by the inner surface of each groove portion 746 of the flow channel surface SB1 and the fixing surface SA2 of the base portion 722, are formed. Each flow channel Q is a pathway through which the introduction ports 732 of the base portion 722 and the communication ports 744 are in communication with one another. That is, among the portions of the mounting portion 72, the ink that is accommodated in a single arbitrary liquid container 14, is supplied to an introduction port 732 of the base portion 722, and is supplied to a single introduction port 854 of the liquid ejecting head 80 as a result of flowing into a communication port 744 via a flow channel Q that is configured by a groove portion 746. Additionally, it is also possible to form the flow channels Q using groove portions that are formed in the fixing surface SA2 of the base portion 722 and the flow channel surface SB1 of the sealing portion 74, and to form the flow channels Q using groove portions that are formed in the fixing surface SA2 of the base portion 722 and the flow channel surface SB1 of the sealing portion 74.

As can be understood from the above-mentioned description, the mounting portion 72 and the sealing portion of the embodiment function as a flow channel portion 78 that includes the flow channels Q through which ink passes. More specifically, as illustrated by way of example in FIG. 2, a range from the mounting surface SA1 of the mounting portion 72 up to the exterior outer surface SB2 of the sealing portion corresponds to the range in the Z direction of the flow channel portion 78.

Since the flow channels Q in the inner portion of the flow channel portion 78 are pathways for supplying the ink that is accommodated in each liquid container 14 to the liquid ejecting head 80, in a case of viewing from the Z direction, the flow channel portion 78 is formed to a size that follows the arrangement (the Y direction) of the plurality of liquid containers 14 throughout the plurality of liquid containers 14.

Further, the liquid ejecting head 80 is stacked in the Z direction (the first direction) with respect to the flow channel portion 78.

As illustrated by way of example in FIG. 2, the support body 60 is a substantially box form structural body that includes a bottom surface portion 62 and peripheral wall portions 64, and for example, is formed by injection molding of a resin material. Additionally, in FIG. 4, among portions of the support body 60, illustration of the peripheral wall portions 64 is omitted for the sake of convenience, and only the bottom surface portion 62 is illustrated. As illustrated by way of example in FIGS. 2 and 4, the bottom surface portion 62 is a substantially flat plate form section that includes a first surface SC1, which is an outer surface on the mounting portion 72 side, and a second surface SC2 on a side that is opposite to the first surface SC1. The second surface SC2 is a facing surface to the medium 12. As can be understood from FIG. 2, the peripheral wall portions 64 are wall form sections that project along the peripheral edges of the first surface SC1 from the first surface SC1 throughout the entire periphery of the base portion 722. Insertion holes 642, through which the guide shaft 54 is inserted, are formed in the peripheral wall portions 64, and the transport belt 52 is fixed thereto.

Furthermore, a concave portion 63 that accommodates the sealing portion 74, which is a portion of the flow channel portion 78, is formed in the bottom surface portion 62. That is, the sealing portion 74 is disposed in the midst of the concave portion 63, which is recessed on the positive side in the Z direction from the first surface SC1 of the bottom surface portion 62, and the sealing portion 74 and the bottom surface portion 62 are disposed laying on top of one another in the Z direction. In this instance, in the specification of the present application, the sealing portion 74 and the bottom surface portion 62 laying on top of one another in the Z direction refers to at least a portion of the sealing portion and at least a portion of the bottom surface portion 62 being present within the same X-Y plane. As a result of the sealing portion 74 and the bottom surface portion 62, which are a portion of the flow channel portion 78, laying on top of one another in the Z direction, in comparison with a case in which the sealing portion 74 and the bottom surface portion 62 are not laying on top of one another in the Z direction, that is, in a case in which the sealing portion 74 is stacked on the bottom surface portion 62 and there is not an X-Y plane in which both components are present, it is possible to reduce the profile of the liquid ejecting unit 40 in the Z direction corresponding to an amount by which the sealing portion 74 and the bottom surface portion 62 lay on top of one another in the Z direction.

As illustrated by way of example in FIG. 4, the mounting portion 72 of the container holding body 70 is fixed to the bottom surface portion 62 (the first surface SC1) of the support body 60 by the plurality of screws 76, which are an example of a connection portion. More specifically, the mounting portion 72 is fixed to the support body 60 and the support body 60 supports the flow channel portion 78 as a result of four screws 76 that are inserted into each through hole 734 of the base portion 722 of the container holding body 70, being inserted into each through hole 624 that is formed in the corner portions of the bottom surface portion 62 of the support body 60. Additionally, the structure (the connection portions) for mutually fixing the container holding body 70 and the support body 60 is not limited to the above-mentioned illustrative example. For example, it is also possible to adopt a configuration in which the container holding body 70 is fixed to the support body 60 using an adhesive, or a configuration in which the container holding body 70 is fixed to the support body 60 by causing deformation (for example, thermal caulking) as a result of inserting caulking pins that are formed in one of the container holding body 70 and the support body 60, into the other of the container holding body 70 and the support body 60.

As illustrated by way of example in FIGS. 2 and 4, the liquid ejecting head 80 is fixed to the bottom surface portion 62 of the support body 60. More specifically, the liquid ejecting head 80 is accommodated in an accommodation portion (a concave portion) 622 that is formed in the bottom surface portion 62. In the above-mentioned manner, in a state in which the container holding body 70 is fixed to the support body 60, each communication port 744 of the sealing portion 74 is in communication with each introduction port 854 of the liquid ejecting head 80. The liquid ejecting head 80 ejects ink that is supplied as a result of passing through the flow channels Q (the groove portions 746) in the inner portion of the flow channel portion 78, from the plurality of nozzles N.

Figure 5:
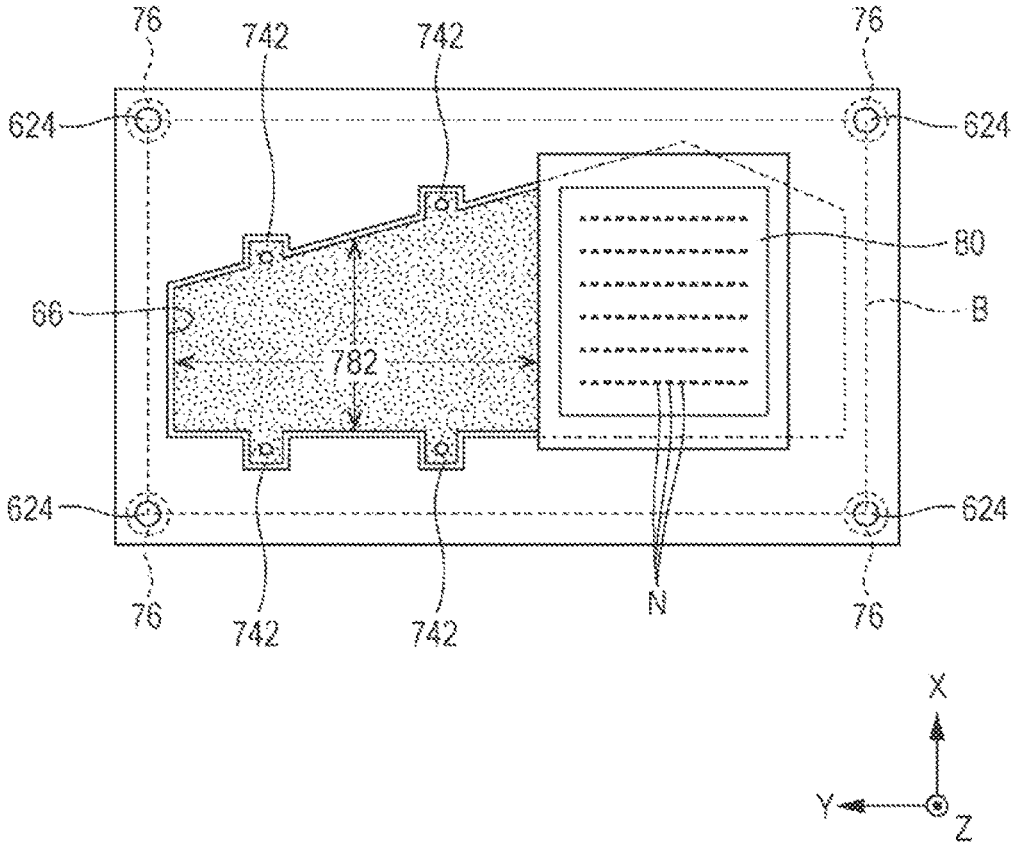
FIG. 5 is a plan view when the liquid ejecting unit is viewed from a medium side.

FIG. 5 is a plan view when the liquid ejecting unit 40 is viewed from the positive side in the Z direction (the medium 12 side).

As illustrated by way of example in FIGS. 4 and 5, an opening 66 is formed in the support body 60. Among portions of the support body 60, the opening 66 of the embodiment is formed inside the concave portion 63 of the bottom surface portion 62, to which the liquid ejecting head 80 is fixed.

As can be understood from FIG. 5, if a region B that is demarcated by the plurality of screws 76 for fixing the container holding body 70 to the support body 60, is assumed, in a case of viewing from the Z direction, the concave portion 63 and the opening 66 are positioned on the inner side of the region B. In other words, when viewed in a planar manner from the Z direction, the flow channel portion 78 is disposed inside the region B. The region B is a rectangular region through which the respective central axes of the plurality of screws 76 pass. Since it is assumed that it is likely that an exposed portion 782, which will be mentioned later, will come into contact with a component (for example, the transport mechanism 32) in the periphery of the liquid ejecting head 80 via the opening 66 of the support body 60, it is possible to suppress deformation of the flow channel portion 78 as a result of the exposed portion 782 of the flow channel portion 78 being disposed inside the region B that is demarcated by the plurality of screws 76, which correspond to the plurality of connection portions.

In a case of viewing from the Z direction, the opening 66 of the embodiment is formed in a shape that follows the external form of the exposed portion 782 so as to overlap with a specific section (hereinafter, referred to as the "exposed portion") 782 among sections of the flow channel portion 78 (the sealing portion 74). That is, the exposed portion 782 is exposed on the inner side of the opening 66 of the support body 60 when viewed from the negative side in the Z direction.

In a case of viewing from the Z direction, the exposed portion 782 is included in a section, among sections of the flow channel portion 78, that does not overlap with the liquid ejecting head 80. That is, in a case of viewing from the Z direction, among portions of the flow channel portion 78, at least a portion of a section that overlaps with a portion of the plurality of liquid containers 14 but does not overlap with the liquid ejecting head 80, is the exposed portion 782. In the present embodiment, when viewed in a planar manner from the Z direction, since the range over which the plurality of liquid containers 14 are disposed is wider than the range of the liquid ejecting head 80, the flow channel portion 78 in which the flow channels Q for supplying the ink to the liquid ejecting head 80 from the plurality of liquid containers 14 are formed, is installed so as to overhang from the liquid ejecting head 80 in the Z direction in particular. Among sections of the flow channel portion 78, a section that overhangs from the peripheral edge of the liquid ejecting head is equivalent to the exposed portion 782. More specifically, in the embodiment, since the liquid ejecting head 80 is disposed in the liquid ejecting unit 40 on the upstream side in the transport direction of the medium 12 (the Y direction), and the plurality of liquid containers 14 are arranged aligned in the transport direction of the medium 12 (the Y direction), the exposed portion 782 is a portion of the flow channel portion 78 that overhangs from the liquid ejecting head 80 on the downstream side in the transport direction of the medium 12. Accordingly, as can be understood from FIG. 2, the discharge side transport mechanism 34, which is installed on the downstream side in the transport direction of the medium 12 (the Y direction) of the liquid ejecting head 80, and the exposed portion 782 are disposed facing one another. That is, in the Z direction, the exposed portion 782 is positioned directly above the discharge side transport mechanism 34. In the present embodiment, the liquid ejecting unit 40 prevents interference of the support body 60 and the discharge side transport mechanism 34 as a result of the opening 66 being provided in a position that faces the discharge side transport mechanism 34.

The flow channel portion 78 is disposed so that at least a portion (the sealing portion 74) of the flow channel portion 78 is accommodated on the inner side of the concave portion 63 of the support body 60. More specifically, the positions in the Z direction (that is, the axial direction of the nozzles N) of at least a portion (the sealing portion 74) of the flow channel portion 78 and the bottom surface portion 62 of the support body 60 overlap at least partially. In the embodiment that is shown in FIG. 2, a configuration in which the entirety of the sealing portion 74 is accommodated on the inner side of the concave portion 63, and the entirety of the sealing portion 74 is positioned within the range in the Z direction of the bottom surface portion 62, is shown, but it is also possible to use a configuration in which a portion of the sealing portion 74 or at least a portion of the sealing portion 74 and the mounting portion 72 are positioned within the range in the Z direction of the bottom surface portion 62. That is, as can be understood from FIG. 2, the positions in the Z direction of at least a portion of the range (a range from the mounting surface SA1 of the base portion 722 up to the exterior outer surface SB2 of the sealing portion 74) in the Z direction of the flow channel portion 78, and at least a portion (from the exterior outer surface SB2 to the flow channel surface SB1 of the sealing portion 74) of the range (a range from the first surface SC1 up to the second surface SC2) of the bottom surface portion 62 in the Z direction overlap with one another. Additionally, the exterior outer surface SB2 of the exposed portion 782 is positioned on the container holding body 70 side when viewed from the second surface SC2 of the bottom surface portion 62. That is, the exterior outer surface SB2 of the exposed portion 782 is in a position that is recessed with respect to the second surface SC2 of the bottom surface portion 62. In other words, it is also possible to use a configuration in which the exterior outer surface SB2 of the flow channel portion 78 is positioned between the first surface SC1 and the second surface SC2 of the bottom surface portion 62 in the Z direction. As a result of this, it is possible to reduce the thickness in the Z direction of the liquid ejecting unit 40, which corresponds to the exposed portion 782.

Figure 6:
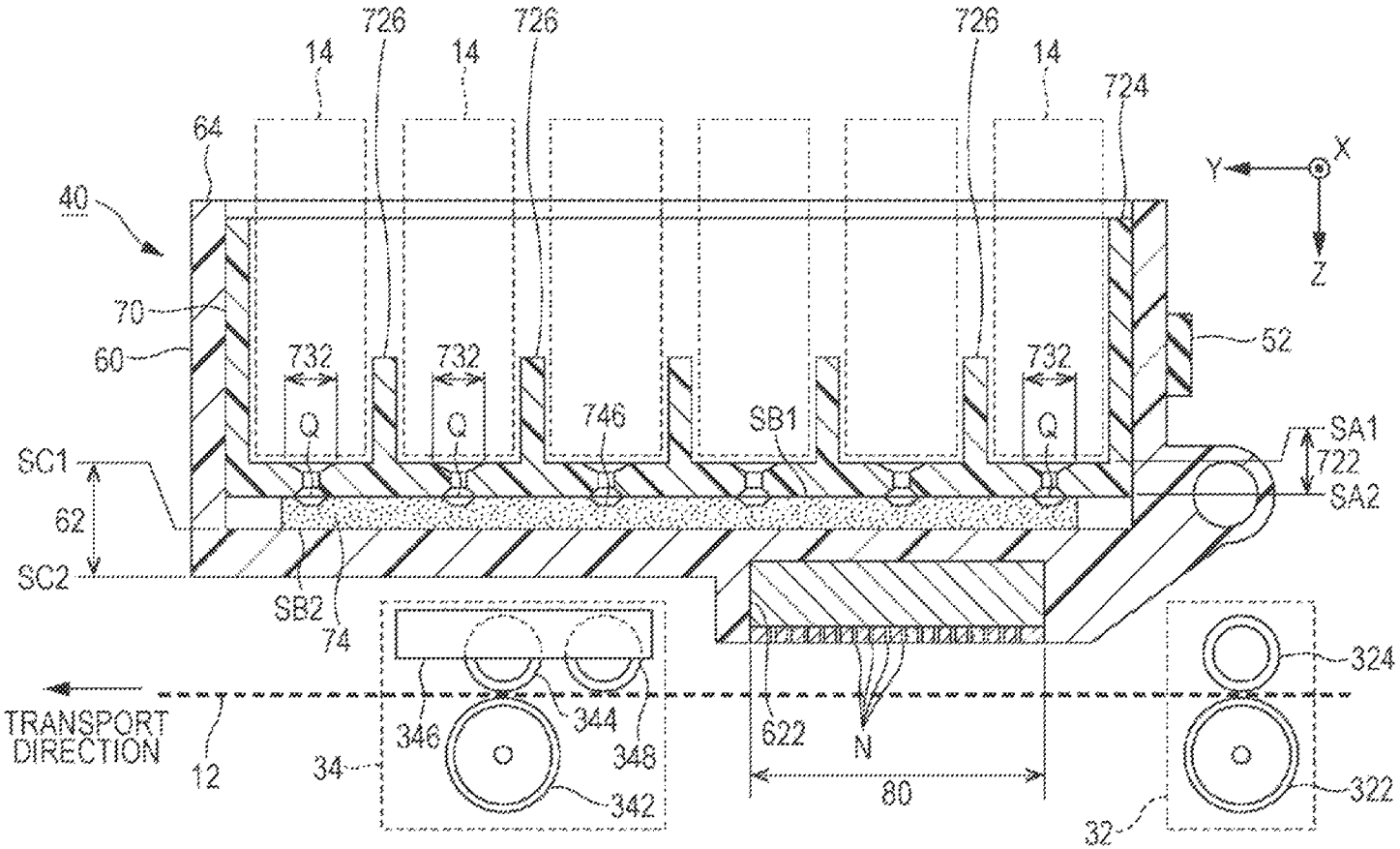
FIG. 6 is a configuration view of a comparative example.

FIG. 6 is a cross-sectional view (a cross-section that corresponds to FIG. 2) illustrating a configuration in which the concave portion 63 and the opening 66 are not formed in the support body 60, as a comparative example of the embodiment. As illustrated by way of example in FIG. 6, in the comparative example, the container holding body 70 is fixed to the support body 60 so that the exterior outer surface SB2 of the sealing portion 74 faces the first surface SC1 (the upper surface) of the bottom surface portion 62 of the support body 60. That is, in the comparative example, since the concave portion 63 and the opening 66 are not formed in the support body 60, at least a portion (the sealing portion 74) of the flow channel portion 78, and at least a portion of the bottom surface portion 62 of the support body 60 do not overlap in the Z direction.

Meanwhile, in the embodiment, in a case of viewing from the Z direction, since the concave portion 63, which can be inlayed into the flow channel portion 78 in the Z direction, is formed in the support body 60, it is possible to accommodate the sealing portion 74 on the inner side of the concave portion 63, and therefore, the positions in the Z direction of at least a portion (the sealing portion 74) of the flow channel portion 78 and at least a portion (a section that corresponds to the concave portion 63) of the bottom surface portion 62 of the support body 60 overlap.

Accordingly, in comparison with the comparative example, the dimension in the Z direction of the liquid ejecting unit 40 is reduced corresponding to the amount by which at least a portion (the sealing portion 74) of the flow channel portion 78 and the concave portion 63 of the bottom surface portion 62 overlap in the Z direction, the profile of the liquid ejecting unit 40 is reduced in the Z direction, the dimension in the Z direction of the liquid ejecting apparatus 10 is reduced, and therefore, it is possible to reduce the profile of the liquid ejecting apparatus 10 in the Z direction.

In addition, in the comparative example of FIG. 6, the discharge side transport mechanism 34, which is positioned on the positive side in the Z direction of the liquid ejecting unit 40, is disposed preserving a distance at which the discharge side transport mechanism 34 does not interfere with the second surface SC2 of the support body 60. Meanwhile, in the embodiment of FIG. 2, since the opening 66 is provided in a position that faces the discharge side transport mechanism 34, it is possible to bring the liquid ejecting unit 40 and the discharge side transport mechanism 34 closer in the Z direction up to a position in which the discharge side transport mechanism 34 does not interfere with the exterior outer surface SB2 of the exposed portion 782, which is exposed on the inner side of the opening 66. As a result of this, the dimension in the Z direction of the liquid ejecting apparatus is reduced, and therefore, miniaturization of the liquid ejecting apparatus 10 in the Z direction is possible. In the embodiment, since the exposed portion 782 of the flow channel portion 78 is positioned inside the opening 66 on the inner side of the region B, which is demarcated by the plurality of screws 76 that connect the container holding body 70 (the mounting portion 72) to the support body 60, and is positioned in a recessed position on the first surface SC1 side with respect to the second surface SC2 of the bottom surface portion 62, even in a case in which deformation (warping and distortion) occurs in the flow channel portion 78, the likelihood of interference or contact between the flow channel portion 78, the transport mechanism 34 and other members is reduced. For example, in the manner of the embodiment, in a case of viewing from the Z direction, in a configuration in which the exposed portion 782 of the flow channel portion 78 overlaps with the transport mechanism 34, since it is assumed that it is likely that the exposed portion 782 will come into contact with the transport mechanism 34 via the opening 66 of the support body 60, a configuration in which the exposed portion 782 of the flow channel portion 78 is positioned inside a region that is demarcated by the plurality of screws 76 is particularly preferable.

As a result of such a configuration, among positions of the support body 60, at a position that corresponds to the connection portions that fix the mounting portion 72 (the flow channel portion 78), a thickness at which it is possible to ensure rigidity is secured, and it is possible to minimize the distance in the Z direction from another constituent element (for example, the discharge side transport mechanism 34) that faces the exposed portion 782. In the embodiment, the other constituent element that faces the exposed portion 782 is the discharge side transport mechanism 34, but it is possible to use a configuration in which another constituent element that configures the liquid ejecting apparatus 10 and the exposed portion 782 face one another.

MODIFICATION EXAMPLES

The form that is illustrated by way of example above can be modified in a variety of ways. Aspects of specific modifications are illustrated by way of example below. Two or more aspects chosen arbitrarily from the following examples can be combined as appropriate within a range in which the aspects do not contradict one another.

(1) In the above-mentioned embodiment, a configuration in which the container holding body 70 holds the plurality of liquid containers 14 is illustrated by way of example, but it is also possible for the container holding body 70 to hold a single-body liquid container in which a plurality of spaces, which accommodate different types of ink, are formed. In addition, in the above-mentioned embodiment, a configuration (a so-called on-carriage structure) in which the liquid containers 14 are mounted on the support body 60 is illustrated by way of example, but the configuration by which the liquid containers 14 are mounted on the support body 60 is not essential to the invention. That is, it is also possible to adopt a configuration (a so-called off-carriage structure) in which the liquid containers 14 are installed in locations (for example, the housing of the liquid ejecting apparatus 10) other than the support body 60. In addition, the specific form of the liquid containers 14 is not limited to cartridges. For example, bag form packs that are formed using a flexible film or tanks that can be filled with ink can also be used as the liquid containers 14.

(2) In the above-mentioned embodiment, in a case of viewing from the Z direction, the opening 66 is formed in the support body 60 so as to overlap with the exposed portion 782, which is a portion of the flow channel portion 78, but it is also possible to set the entirety of the sealing portion 74 as the exposed portion 782 and form the opening 66 so as to overlap with the exposed portion 782 (that is, the entirety of the sealing portion 74). In other words, when viewed in a planar manner in the Z direction, the entire region of the concave portion 63 corresponds to the region of the opening 66.

Additionally, in a case in which the entirety of the sealing portion 74 is set as the exposed portion 782 and the opening 66 is formed so as to overlap with the exposed portion 782, since it is difficult to provide the accommodation portion 622, which accommodates the liquid ejecting head 80, for example, it is preferable that the liquid ejecting head 80 be directly fixed to the sealing portion 74 of the mounting portion 72 using an adhesive or an arbitrary fixing method such as screwing with screws.

(3) In the above-mentioned embodiment, a configuration in which the support body 60 includes the bottom surface portion 62 is illustrated by way of example, but the bottom surface portion 62 may be omitted. For example, it is also possible to form the support body 60 using the peripheral wall portions 64 only.

In a configuration in which the support body 60 is formed using the peripheral wall portions 64, the space that is surrounded by the peripheral wall portions 64, functions as the concave portion 63 and the opening 66, and the entirety of the flow channel portion 78 is exposed from the opening 66. In this case, in the same manner as (2) mentioned above, it is possible to directly fix the liquid ejecting head 80 to the sealing portion 74 of the mounting portion 72, and the support body 60 supports the flow channel portion 78 as a result of the mounting portion 72 being fixed to the peripheral wall portions 64. On the other hand, it is also possible to omit the peripheral wall portions 64 of the support body 60 that are illustrated by way of example in the above-mentioned embodiment.

(4) In the above-mentioned embodiment, a configuration in which the container holding body 70 includes both the mounting portion 72 and the flow channel portion 78 is illustrated by way of example, but it is also possible to configure such that the mounting portion 72 and the flow channel portion 78 are mutually separate bodies. In addition, it is also possible to omit the side wall portions 724 and the dividing wall portions 726 of the container holding body 70.

(5) In the above-mentioned embodiment, a serial type liquid ejecting apparatus 10 that reciprocates and in which the liquid ejecting head 80 is mounted on the support body 60 (a carriage) is illustrated by way of example, but the invention can also be applied to a line type liquid ejecting apparatus in which a plurality of nozzles are distributed throughout the entire area in the width direction of the medium 12. The support body 60 (a carriage) that is illustrated by way of example in the above-mentioned embodiment and a structural body that supports the liquid ejecting head in a line type liquid ejecting apparatus can be inclusively represented as support bodies that support a liquid ejecting head.

(6) In the liquid ejecting apparatus 10 in the above-mentioned embodiment, a desired image is formed on the outer surface of the medium 12 as a result of the transport mechanism 30 transporting the medium 12 in the Y direction (a horizontal direction), and the liquid ejecting head 80 ejecting the ink in the Z direction (the vertical direction). Furthermore, as a result of the exposed portion 782 of the flow channel portion 78 and the bottom surface portion 62 of the support body 60 being disposed so as to overlap in the Z direction (the vertical direction), the dimension in the Z direction (the vertical direction) of the liquid ejecting unit 40 is reduced, the profile of the liquid ejecting unit 40 is reduced in the Z direction (the vertical direction), the dimension in the Z direction (the vertical direction) of the liquid ejecting apparatus 10 is reduced, and therefore, miniaturization of the liquid ejecting apparatus 10 in the Z direction (the vertical direction) is possible.

The liquid ejecting apparatus 10 may have a configuration that forms a desired image on the outer surface of the medium 12 as a result of the transport mechanism 30 transporting the medium 12 in the vertical direction, and the liquid ejecting head 80 ejecting the ink in the horizontal direction. In such a configuration, the exposed portion 782 of the flow channel portion 78 and the bottom surface portion 62 of the support body 60 are disposed so as to overlap in the horizontal direction. As a result of the exposed portion 782 of the flow channel portion 78 and the bottom surface portion 62 of the support body 60 being disposed so as to overlap in the horizontal direction, the dimension in the horizontal direction of the liquid ejecting unit 40 is reduced, the profile of the liquid ejecting unit 40 is reduced in the horizontal direction, the dimension in the horizontal direction of the liquid ejecting apparatus 10 is reduced, and therefore, miniaturization of the liquid ejecting apparatus 10 in the horizontal direction is possible.

(7) In addition to machines that are dedicated to printing, a similar configuration to that of the liquid ejecting apparatus 10 that is illustrated by way of example in the embodiment can be applied to various machines facsimile apparatuses and copy machines. However, the applications of the liquid ejecting apparatus of the present invention are not limited to printing. For example, a liquid ejecting apparatus that ejects a solution of a color material can be used as a manufacturing apparatus that forms color filters of a liquid crystal display apparatus. In addition, a liquid ejecting apparatus that ejects a solution of a conductive material can be used as a manufacturing apparatus that forms wiring of wiring substrates and electrodes.

What is claimed is:

1. A liquid ejecting unit comprising:

a first flow channel portion;

a support body having a first outer surface to which the first flow channel portion is fixed;

a liquid ejecting head fixed to the support body; and a second flow channel portion having a second outer surface that faces the first flow channel portion and a third outer surface that is opposite to the second outer surface, the third outer surface facing the support body, wherein the support body is provided with a concave portion, the second flow channel portion is accommodated inside the concave portion so that the second outer surface does not extend above the first outer surface, and the first outer surface and the second outer surface are co-planar.

2. The liquid ejecting unit according to claim 1, wherein the second flow channel portion is a substantially flat plate member.

3. The liquid ejecting unit according to claim 1, wherein the second flow channel portion has a flow channel extending in a plane that is parallel to the first outer surface.

4. A liquid ejecting unit comprising:

a first flow channel portion;

a support body having a first outer surface to which the first flow channel portion is fixed;

a liquid ejecting head fixed to the support body; and a second flow channel portion having a second outer surface that faces the first flow channel portion and a third outer surface that is opposite to the second outer surface, the third outer surface facing the support body, wherein the support body is provided with a concave portion, the second flow channel portion is accommodated inside the concave portion so that the second outer surface does not extend above the first outer surface, and the first flow channel portion has a surface onto which a liquid container is mounted.

5. A liquid ejecting unit comprising:

a first flow channel portion;

a support body having a first outer surface to which the first flow channel portion is fixed; and a second flow channel portion having a second outer surface that faces the first flow channel portion and a third outer surface that is opposite to the second outer surface, the third outer surface facing the support body, wherein the support body is provided with a concave portion, and the second flow channel portion is accommodated inside the concave portion so that the second outer surface does not extend above the first outer surface and is co-planar with the first outer surface.

6. The liquid ejecting unit according to claim 5, wherein the second flow channel portion is a substantially flat plate member.

7. The liquid ejecting unit according to claim 5, wherein the second flow channel portion has a flow channel extending in a plane that is parallel to the first outer surface.

* * * * *